US012667928B2

(12) United States Patent
Giese

(10) Patent No.: US 12,667,928 B2
(45) Date of Patent: Jun. 30, 2026

(54) UNIT FOR DEBURRING AND ROUNDING EDGES IN A SURFACE GRINDING MACHINE

(71) Applicant: KARL HEESEMANN MASCHINENFABRIK GMBH & CO. KG, Bad Oeynhausen (DE)

(72) Inventor: Christoph Giese, Bad Oeynhausen (DE)

(73) Assignee: KARL HEESEMANN MASCHINENFABRIK GMBH & CO. KG, Bad Oeynhausen (DE)

( * ) Notice: Subject to any disclaimer, the term of this patent is extended or adjusted under 35 U.S.C. 154(b) by 336 days.

(21) Appl. No.: 18/548,732

(22) PCT Filed: Mar. 4, 2022

(86) PCT No.: PCT/EP2022/055507
§ 371 (c)(1),
(2) Date: Sep. 1, 2023

(87) PCT Pub. No.: WO2022/184882
PCT Pub. Date: Sep. 9, 2022

(65) Prior Publication Data

US 2024/0149386 A1 May 9, 2024

(30) Foreign Application Priority Data

Mar. 5, 2021 (DE) ..... 10 2021 105 394.3

(51) Int. Cl.
*B24B 9/00* (2006.01)

(52) U.S. Cl.
CPC ..... *B24B 9/00* (2013.01)

(58) Field of Classification Search
CPC ..... B24B 41/047; B24B 7/12; B24B 7/28; B24B 27/033; B24B 29/00
See application file for complete search history.

(56) References Cited

U.S. PATENT DOCUMENTS 1,666,347 A 4/1928 Platt
1,684,029 A * 9/1928 Howard ..... B24B 7/244 451/271

(Continued)

FOREIGN PATENT DOCUMENTS

DE 31 28 703 C2 9/1983
DE 295 08 657 U1 9/1995

(Continued)

OTHER PUBLICATIONS

Bibliographic Data for KR20150020766A Apr. 9, 2009.
Taiwanese Office Action 11421373740, issued Dec. 30, 2025.
Chinese Office Action of Mar. 26, 2026.

*Primary Examiner* — Joel D Crandall
(74) *Attorney, Agent, or Firm* — WCF IP

(57) ABSTRACT

The present invention relates to an edge machining unit for a surface grinder, comprising: a plurality of cylindrical rotary brushes with a cylindrical surface and a plurality of brushes on said cylindrical surface, wherein each cylindrical rotary brush has a first axis of rotation, which corresponds to a central longitudinal axis of the cylindrical rotary brush, a first drive unit for driving each rotary brush in a rotational movement about its first axis of rotation, a plurality of second axes of rotation, which plurality is not parallel to the first axis of rotation, wherein each first axis of rotation is disposed so as to rotate about one of the second axes of rotation, a second drive unit for moving every first axis of rotation in rotation about its second axis of rotation, and a third axis of movement, wherein the second axes of rotation are guided for a movement guided by the third axis of movement, and a third drive unit for moving the second axes of rotation in a movement guided by the third axis of movement.

29 Claims, 8 Drawing Sheets

(56) References Cited

U.S. PATENT DOCUMENTS

Figure 1:
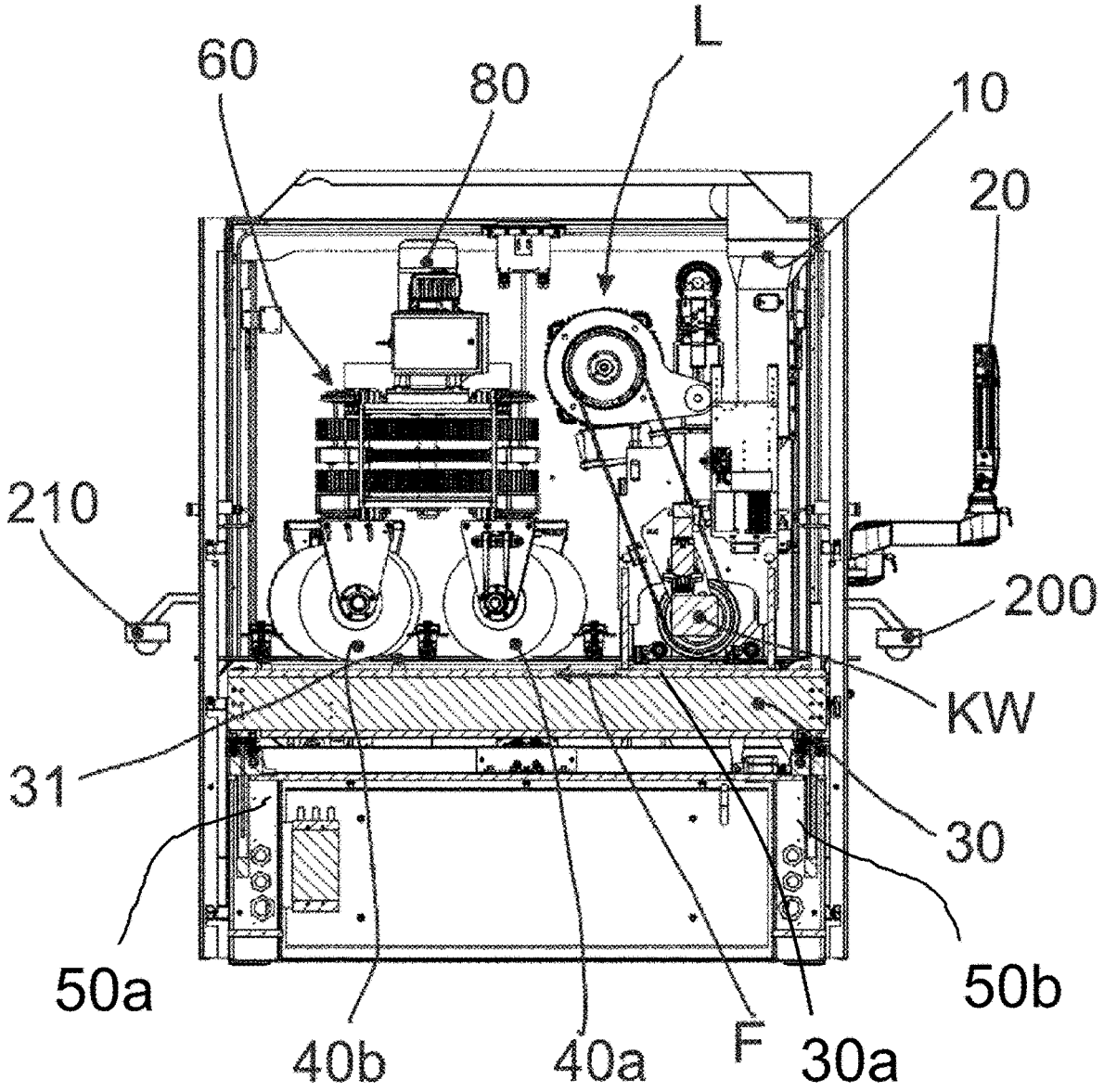

| | | | | |
|---|---|---|---|---|
| 4,396,836 | A | 8/1983 | Vitaliani | |
| 4,615,146 | A * | 10/1986 | Tassoni | B27M 1/003 451/184 |
| 5,274,962 | A * | 1/1994 | Hundebol | B24B 41/047 451/28 |
| 5,441,440 | A | 8/1995 | Hundebol | |
| 5,558,561 | A * | 9/1996 | Hundebol | B24B 41/047 451/178 |
| 6,015,334 | A * | 1/2000 | Hundebøl | B24B 9/04 451/28 |
| 6,234,887 | B1 * | 5/2001 | Hundebøl | B24B 7/28 451/358 |
| 6,244,933 | B1 * | 6/2001 | Morkvenas | B24B 47/22 451/10 |
| 7,775,858 | B2 * | 8/2010 | Weber | B24B 41/047 451/271 |
| 10,518,378 | B2 * | 12/2019 | Hundebol | B24B 27/0076 |
| 2007/0099546 | A1 | 5/2007 | Jespersen | |
| 2009/0093197 | A1 | 4/2009 | Ernst | |
| 2011/0003539 | A1 | 1/2011 | Jespersen | |
| 2013/0137346 | A1 | 5/2013 | Toncelli | |

FOREIGN PATENT DOCUMENTS

| | | | |
|---|---|---|---|
| DE | 196 11 932 | A1 | 11/1996 |
| DE | 10 2005 011 330 | A1 | 9/2006 |
| DE | 20 2013 102 671 | U1 | 10/2014 |
| DE | 10 2016 117 991 | A1 | 3/2018 |
| EP | 0 471 641 | A2 | 2/1992 |
| EP | 1 541 285 | A1 | 6/2005 |
| EP | 1 779 970 | A1 | 5/2007 |
| EP | 2 047 948 | A2 | 4/2009 |
| EP | 2 011 602 | B1 | 10/2010 |
| EP | 2 586 565 | A2 | 5/2013 |
| KR | 10-2013-0097609 | A | 2/2015 |
| KR | 2015-0020766 | A | 2/2015 |
| WO | 2003/072304 | A1 | 9/2003 |
| WO | WO 2012/039072 | A1 | 3/2012 |
| WO | WO 2012/046915 | A1 | 4/2012 |

* cited by examiner

UNIT FOR DEBURRING AND ROUNDING EDGES IN A SURFACE GRINDING MACHINE

The invention relates to an edge machining assembly for a surface grinding machine.

Grinding machines are generally used to machine surfaces of a workpiece. This surface machining often serves to produce a desired surface quality, in particular to plane the surface and reduce the roughness of the surface. Particular objects for machining by grinding can also be to produce a desired surface structure in order to obtain technical or optical properties of the surface. In principle, grinding machines are used for all types of materials, that is to say wood materials, metal materials, plastics and ceramic materials.

Surface grinding machines are distinguished in that they are designed in particular for machining plate-like workpieces. Such surface grinding machines are often designed in such a way that the plate-like workpiece is conveyed through the surface grinding machine by means of a conveying device with the surface that is to be machined being in a horizontal alignment, and in the process is machined by one or more machining assemblies arranged in a row along the conveying direction. This makes it possible to give the surface the desired surface quality in successive machining steps. Surface grinding machines are also suitable for placing multiple plate-like workpieces onto the conveying device next to one another and then conveying and machining them in parallel through the surface grinding machine. A particular requirement in this respect is then to machine these parallel workpieces uniformly, that is to say to achieve similar and uniform machining over the entire machining width transversely to the conveying direction of the workpieces, and to keep this up even after multiple machining operations and correspondingly occurring tool wear.

A particular operational requirement which is likewise implemented in grinding machines and surface grinding machines is edge machining. Edge machining is carried out on the one hand on outer edges of a plate-like workpiece, that is at the edges that define the outline of the workpiece and are between the peripheral side surfaces and the surface of the workpiece. On the other hand, edge machining is performed on edges which are formed at apertures of the workpiece, such as drilled holes, punched openings or openings produced by means of laser or flame cutting, or openings or depressions created in some other way in the plate-like workpiece.

In this respect, edge machining can include, for the one part, deburring, that is to say the removal of a material burr which is left behind by the operation for producing the opening or the outer contour, in order to achieve a cleaner edge without such a production-induced burr as a result. Edge machining can, for the other part, also include rounding of an edge, which is to be understood to mean an enlargement of the edge radius as a result of the edge machining. Both deburring and rounding of an edge are used for the one part for operational purposes, such as suitability of the workpiece for a certain intended use, for example for avoiding damage in contact with other surfaces, improving the corrosion protection by virtue of a better lacquer layer or coating thickness at the edge, and for the other part also for work safety aspects, such as avoiding injuries to the operator or to the downstream user owing to the edges during further handling of the workpiece.

The edge machining of workpieces such as plate-like workpieces is, however, subject to specific problems and in particular problems which do not arise in the course of grinding surfaces of such workpieces by machining. Firstly, in the case of edge machining, it is sought to subject the edge to machining, but in the process to change the surfaces adjoining the edge as little as possible or not at all, in particular to machine them as little as possible or not at all. This relates in particular also to the two surfaces forming the edge, that is to say often the surface of the workpiece itself and the peripheral side surfaces of the workpiece or the peripheral inner surfaces of an opening or recess in the workpiece.

A further specific problem of edge machining is that often edges are present in completely different orientations on the workpiece. Thus, for example in relation to a longitudinal direction of the plate-like workpiece, which can correspond for example to a conveying direction of the workpiece through a grinding machine, an edge may be parallel to this longitudinal direction, perpendicular to this longitudinal direction or oblique to this longitudinal direction. Each of these alignments can lead to different deburring and rounding efficiencies when the edge machining is carried out. In addition, the deflection of grinding elements of the grinding tool at the edge causes the grinding tool to act locally differently on the surface adjoining the edge on the basis of the alignment of the edge. This problem is in particular exacerbated in that, in one and the same workpiece, edges with different alignments can occur, or that a single recess, for example a circular opening, has edges with practically any angular alignment in relation to the longitudinal direction of the workpiece and other edges, for example edges at rectangular recesses, have edges with four defined different alignments in relation to the longitudinal direction and additionally provide additional problems for the edge machining in the corners of the rectangular recess.

Added to this is the fact that the edge machining is extremely strongly influenced by the machining direction taken through the machining tool. Thus, even in the case of edges that have the same alignment in terms of their edge line, it is crucial for the effectiveness of the edge machining whether the edge machining is carried out with the tool moving out of the recess onto the surface or moving from the surface into the recess, or whether the machining direction runs parallel to the edge or obliquely in relation to the edge.

A further complication in edge machining is that two adjacent edges can mutually influence the machining, the intensity of this influence on the basis of the spacing between the two edges. Thus, for example in the case of edge machining at narrow slot openings, it is frequently possible to observe a deflection and influence of the edge machining tool by the edge first engaged by the grinding tool, the result of this being that the machining of the edge which comes next in the machining direction is influenced by the preceding edge. This phenomenon does not arise in the case of edges at large-area recesses or in the case of outline edges of the workpiece—but it does greatly influence the edge quality at such slot openings in a workpiece.

In this respect, the edge machining of plate-like workpieces strives, for all these edge constellations arising in practice and in particular also when different edge constellations arise on one and the same workpiece, to provide edge machining which acts in the same way and achieves the same result, and in the process to limit the machining on the edges and to machine the surface of the workpiece as little as possible or not at all. Thus, it is often necessary to carry out the edge machining effectively without damaging or removing a zinc layer or a foil on the surface of the workpiece in the process.

Lastly, an edge machining assembly suitable for a surface grinding machine must also achieve the aforementioned uniformity of machining over the entire machining width.

EP 2 011 602 B1 discloses a grinding machine which makes use of rotating orbital sanders for surface machining, which are guided in circulating fashion on an endless chain. This grinding machine is optimized for high-quality surface machining by grinding, but not for edge machining which involves maximum protection of the surface.

EP 1 541 285 A1 discloses a continuous grinding machine for machining a workpiece surface. This grinding machine uses rotating disk or roller brushes which are moved in translation along a track. The roller brushes can be arranged in different alignments and can be fixed in these alignments. This grinding machine is designed in particular for uniform surface machining (grinding, polishing, roughening) and is furthermore intended to also remove burrs and protruding wood fibers in the course of this surface machining. It has been found that this configuration of the grinding machine is not very suitable for deburring and rounding edges if the surface is to be machined as little as possible or not at all in the process. In particular, the grinding machine, in the embodiment with roller grinding bodies, is not very suitable for carrying out edge machining on workpieces which have edges in different alignments in relation to the longitudinal axis of the workpiece. Lastly, this grinding machine has not proven successful at rounding edges in high quality fashion and avoiding or largely reducing surface machining in the process, when edges that are very close together must be machined.

DE 3 128 703 C2 discloses a machine for deburring the edges of metal sheets or plates. This machine makes use of multiple coaxial roller brushes which are driven in rotation alternately in opposite directions and are guided over the edges of the workpiece. This configuration is suitable for selectively deburring the edges of metal sheets or plates in this way but is not suitable for deburring edges of a plate-like workpiece that have different alignments, as arise when there are recesses in the workpiece.

DE 9 116 648 U1 discloses a grinding machine for grinding wooden workpieces. In the case of this grinding machine, multiple cylinder grinding bodies are arranged on a carousel, with the result that a superposed movement is produced from the rotation of the cylinder grinding bodies and the rotation of the carousel. In addition, the entire carousel can be oscillated back and forth. The grinding machine formed in this way is provided for machining surfaces and is intended in particular also to be able to machine uneven surfaces. The kinematics, however, is suitable in particular for carrying out effective surface machining and in the process obtaining sharp edges—deburring and rounding of edges is not provided and cannot be carried out effectively according to this prior art.

EP 1 051 283 B1 discloses a device for sanding surfaces, in the case of which likewise cylindrical grinding roller bodies are arranged in a carousel arrangement and, for the purpose of surface machining, are rotated both about the roller center axis and about the carousel axis.

The previously known technologies have disadvantages in particular when there are edges on the workpiece that have different alignments and when edges are very close together. An object of the invention is to provide an edge machining assembly which can obtain edge machining, in particular deburring and/or rounding of edges, even in the case of such workpieces with thusly arranged edges, in a better way than the previously known technologies, without machining the surfaces of the workpiece that adjoin the edges in a relevant way in the process. A further aim of the invention is to carry out edge machining on such workpieces with thusly arranged and aligned edges with minimum tool wear.

This object is achieved by an edge machining assembly for a surface grinding machine, comprising: a plurality of cylindrical roller brushes having a cylindrical surface and a multiplicity of radially extending deburring grinding elements on this cylindrical surface, wherein each cylindrical roller brush has a respective first axis of rotation which corresponds to a center longitudinal axis of the cylindrical roller brush, a first drive unit for driving each roller brush in a rotational movement about its first axis of rotation, a plurality of second axes of rotation, which are not aligned parallel to the first axis of rotation, wherein each first axis of rotation is mounted so as to be rotatable about one of the second axes of rotation, a second drive unit for rotating each first axis of rotation about its second axis of rotation, a third movement axis, wherein the second axes of rotation are guided for a movement guided by the third movement axis, and a third drive unit for moving the second axes of rotation in a movement guided by the third movement axis, in the case of which edge machining assembly the third movement axis is in the form of a closed guideway and the second axes of rotation are moved along this closed guideway by the third drive unit.

According to the invention, an edge machining assembly for a surface grinding machine is proposed. The edge machining assembly is provided for insertion in a grinding machine and can be provided as the sole machining assembly of the grinding machine if the grinding machine is intended only for edge machining. The edge machining assembly according to the invention may, however, also be inserted in addition to one or more further machining assemblies, which are provided for example for machining surfaces by grinding, machining by polishing, or further machining operations on a workpiece, in a grinding machine having multiple such assemblies. The grinding machine may itself have a workpiece support surface which conveys the workpieces through the machine and correspondingly relative to the edge machining assembly by means of a conveying device, such as an endless conveyor belt. Such a workpiece support surface may, however, also be a constituent part of the edge machining assembly itself, optionally including a corresponding conveying device. The edge machining assembly can consequently also for example comprise a corresponding endless conveyor belt for receiving and conveying the workpieces through the edge machining assembly.

The edge machining assembly according to the invention comprises a plurality of cylindrical roller brushes. These roller brushes may be one-part or multiple-part and are in the form of cylindrical bodies which have a multiplicity of deburring grinding elements on their circumferential surface. These deburring grinding elements may be flexible, radially extending grinding belt portions for constructing a multi-disk grinding body in the form of a roller brush or be brushes made of a plastics material, optionally also in the form of composite brushes, comprising abrasive particles or peening shot incorporated in or adhering to the surface of plastics wires, such as rubber strips, brushes of metal materials such as steel brushes or brass brushes, which thus comprise corresponding radially extending metal wires, for example in the form of roller grinding bodies which are fitted with wire springs of spring steel wires, or combined roller brushes comprising brushes of different materials on their circumferential surface may be provided. Different roller brushes, which differ for example in terms of the occupation density or the nature of the material of the brushes, can also used in the edge machining assembly.

The cylindrical roller brushes are mounted so as to be rotatable about a first axis of rotation, which corresponds to the center longitudinal axis of the cylindrical roller brush, and are driven for rotation about this axis by means of a first drive unit. The rotation may be continuous rotation in one direction of rotation, wherein the roller brushes can all rotate in the same direction or in different directions of rotation. The rotational movement can also be an oscillating movement, in the course of which the direction of rotation of the roller brush is modified at regular or irregular intervals.

The roller brushes are for their part mounted together with their first axis of rotation in such a way that the entire roller brush and the first axis of rotation are mounted so as to be rotatable about a second axis of rotation. This second axis of rotation is not parallel to the first axis of rotation. Accordingly, each cylindrical roller brush has a first axis of rotation, about which the roller brush rotates and which coincides with the cylinder center axis, and each roller brush is mounted so as to be rotatable about a second axis of rotation, about which this first axis of rotation can be rotated, and in turn is driven in a continuous rotational movement or an oscillating pivoting movement about this second axis of rotation by means of a second drive unit. The number of roller brushes, first axes and second axes is therefore the same, it being understood that it is also possible to use multiple-part roller brushes, in the case of which multiple roller brush segments are mounted coaxially and axially spaced on a first axis of rotation so as to be rotatable about a first axis of rotation and this first axis of rotation in turn is mounted so as to be rotatable about a second axis of rotation.

The rotation about the second axis of rotation is performed by a second drive unit. In principle, within the meaning of the invention a drive unit is understood to mean one or more mechanical components, the effect of which is to transmit the required movement and force for the (rotational) movement. A drive unit can also comprise an actuator, such as a drive motor, which drives the movement via these corresponding mechanical components. Such a drive motor can also be coupled directly to a shaft rotating about the axis of rotation or directly to the roller brush for direct drive, for example in the form of a drive motor which is inside the roller brush, in the manner of a motorized roller. In principle, it should be understood that the first, second and third drive units may be controllable independently of one another, but in alternative configurations it is also possible for two of these drive units or all three drive units to be driven by a shared drive motor, in that its drive power is transmitted via corresponding mechanical transmission elements (the drive units) for the rotational movements and the movements along the closed guideway.

In the case of the edge machining assembly according to the invention, the second axes of rotation are not stationary but are guided movably along a closed guideway and are moved along this closed guideway by the third drive unit. In this respect, a closed guideway is to be understood to mean a displacement distance which, proceeding from a starting point, moves along a path which leads back to this starting point again. The closed guideway may have different shapes. It is preferred if the closed guideway has an oval shape, wherein the longer axis of the oval preferably extends transversely to a conveying direction of the workpieces relative to the edge machining assembly. In particular, it is preferred if the closed guideway has the shape of a lame oval, preferably with $n>2$.

Preferably, the third drive unit is designed to move the second axes along the closed guideway at a constant speed. This makes it possible—by contrast to for example a reciprocal movement, as disclosed in DE 9 116 648 U1, which necessarily requires braking and subsequent acceleration of the translational movement at the reversal points—to avoid the roller brushes unfavorably pausing at the end points of the movement and thus to achieve uniformity of the machining.

According to the invention, three movement axes are therefore provided, with the result that the brush elements serving as grinding bodies of the edge machining assembly according to the invention can be moved with a three-axis movement relative to the workpiece and the conveying movement of the workpiece relative to the edge machining assembly can also be superposed on this three-axis movement. The inventors have identified that the effect of this three- or four-axis movement of the brush elements of the roller brushes relative to the workpiece is effective edge machining which is uniform over the entire machining width, together with maximum protection of the surface of the workpiece against undesired machining. In particular, this has the effect that all the edges on a workpiece are deburred and rounded uniformly, that is to say that after the machining they all have approximately the same edge radius irrespective of where these edges are on the workpiece, at which point the workpiece is placed on the workpiece support surface, and how the edges are aligned. This is achieved in particular also when there are edges on the workpiece that are close together and have different alignments. For the one part, the edges can be deburred in the process. For the other part, the edge machining assembly according to the invention can alternatively or additionally also round the edges.

According to a first preferred embodiment, it is provided that the second axes of rotation are perpendicular to the first axes of rotation, and/or the closed guideway is in a plane which is perpendicular to the second axes of rotation, and/or the closed guideway is in a plane which is parallel to the first axes of rotation. According to this embodiment, in a variant, each first axis of rotation is perpendicular to the second axis of rotation about which it rotates. The first axis of rotation therefore moves in a plane which is perpendicular to the second axis of rotation. In the case of this configuration, with superposed rotations about the first and the second axis of rotation, the circumferential surface of the roller brush can be kept in a line of contact with the workpiece and the contact pressure can be kept the same over the entire length of this line. According to a second variant, which can be provided alternatively or in addition to the first variant, the second axes of rotation are perpendicular to a plane in which the closed guideway extends. The second axes of rotation are therefore moved in translation perpendicularly to their direction of extent by the third drive unit. If the first and the second variant are implemented, the closed guideway is therefore in a plane which is parallel to the first axes of rotation. This configuration can, however, also be obtained independently as a third variant if the first and second axes of rotation are not perpendicular to one another and the second axes of rotation are not perpendicular to the guideway plane.

It is preferred still further if a, preferably each second axis of rotation extends through a respective roller brush, preferably a second axis of rotation intersects a first axis of rotation, in particular each second axis of rotation intersects a respective first axis of rotation. According to this embodiment, the second axis of rotation is in that roller brush which rotates about the first axis of rotation that rotates about the second axis of rotation. This arrangement has the effect that the circumferential speed of the surface of the roller brushes owing to the rotation about the second axis of rotation is not significantly increased on account of a small radius between the second axes of rotation and the roller brushes, but rather is increased both along the line of contact with the workpiece and in one line portion, and reduced in another line portion. In particular, it is preferred for the second axis of rotation to extend through the center of the roller brush in relation to its longitudinal extent along the first axis of rotation, that is to say is spaced from both end faces of the roller brush to the same extent. As an alternative, the second axis of rotation may also be arranged such that it is spaced from this center position by not more than 25%, preferably not more than 10% of the overall length of the roller brush along the first axis of rotation. This has the effect firstly of exerting very little influence on the circumferential speed at the outer circumference of the roller brush owing to the rotation about the second axis of rotation and only exerting an influence on the movement direction of the brush elements relative to the workpiece owing to the rotation about the second axis of rotation to a significant extent. Secondly, along the line of contact with the workpiece, the line section with a reduced relative speed and the line portion with an increased relative speed in relation to the workpiece are approximately the same length.

According to a preferred configuration, it is provided that the second axis of rotation intersects the first axis of rotation. This may be provided for one of the roller brushes, but preferably is provided for each of the roller brushes. It may also be provided here as an alternative that the second axis of rotation extends at a spacing from the first axis of rotation which is less than 25% of the diameter of the roller brush, preferably less than 10% of the diameter of the roller brush.

The edge machining assembly according to the invention may also be developed further by a workpiece support surface and a workpiece conveying device for conveying the workpiece support surface in a workpiece conveying direction, wherein the workpiece support surface is preferably parallel to the first axes of rotation, and/or the workpiece support surface is preferably parallel to a plane in which the closed guideway extends. According to this embodiment, the edge machining assembly comprises a workpiece support surface and a workpiece conveying device, which is designed to convey one or more workpieces through the edge machining assembly, preferably in such an alignment that the workpiece support surface and consequently a planar workpiece supported thereon are parallel to the first axes of rotation and/or parallel to a line of contact of the outer circumferential surface of the roller brushes with the workpiece. Further preferably, the workpiece support surface is alternatively or additionally parallel to the plane of the guideway, and therefore the roller brushes are guided by the movement along the guideway at a constant spacing from the workpiece support surface.

In this respect, it is further preferred if the workpiece support surface has a support width perpendicular to the workpiece conveying direction and the closed guideway extends in the direction of the support width over an extent which is greater than or equal to the support width. According to this embodiment, the closed guideway extends at least far enough to reach over the entire width of the workpiece support surface. It is preferred if the closed guideway extends beyond the support width, with the result that the deflection points, which are lateral in relation to the conveying direction, of the guideway are outside the support width. The roller brushes are consequently deflected by their movement along the closed guideway specifically in the region of the side edge of the workpiece support surface or preferably outside this lateral boundary of the workpiece support surface, with the result that a workpiece or workpieces which extend or are distributed over the entire conveying width can be machined by the edge machining assembly even in terms of all of their outline edges, in particular the machining parameters not being modified owing to the deflection operation of the guideway in the process.

It is still further preferred if the second drive unit comprises a hollow shaft and the first drive unit comprises a drive shaft extending through this hollow shaft. According to this embodiment, the second drive unit comprises a hollow shaft which can rotate about the second axis of rotation and as a result defines the guided rotational movement the first axis of rotation about the second axis of rotation. The configuration with a hollow shaft also makes it possible to drive the brush rollers in rotation about the first axis of rotation by means of a drive shaft extending through this hollow shaft, the drive shaft consequently being a constituent part of the first drive unit. In the case of this configuration, the rotational movement of this drive shaft must still be deflected corresponding to the angle between the first and the second axis of rotation, in particular therefore deflected by 90° degrees. For this deflection operation, it is possible to provide a bevel gear mechanism or deflected drive by means of a drive belt or the like. In principle, it should be understood that this principle can also be reversed, that is to say the hollow shaft is a constituent part of the first drive unit and the drive shaft extending through the hollow shaft is a constituent part of the second drive unit.

It is still further preferred if the first drive unit and the second drive unit comprise an integral drive motor, and/or the second drive unit and the third drive unit comprise an integral drive motor, and/or the first drive unit and the third drive unit comprise an integral drive motor. According to this embodiment, the first and the second drive unit or the second and the third drive unit or the first and the third drive unit or all three drive units are driven by an integral motor, with the result that a correspondingly synchronous movement of the drive units driven together by this integral drive motor is carried out.

According to a preferred embodiment which is an alternative to this, it is provided that the first drive unit comprises a first drive motor, the second drive unit comprises a second drive motor and the third drive unit comprises a third drive motor, and the first, second and third drive motors are connected in signaling terms to a control unit which is designed to actuate the first, second and third drive units independently of one another. According to this embodiment, all three drive units are each equipped with their own drive motor and can consequently be actuated independently of one another by a control unit, that is to say in particular independently in terms of their movement direction, their movement speed and any oscillating movement frequency. This embodiment in particular makes it possible especially well to adapt the edge machining assembly to different materials of the workpieces to be machined, to set a desired degree of rounding of edges to be machined by correspondingly actuating the three drive motors, and to set the edge machining assembly to a dominant alignment of edges to be machined in relation to the conveying direction of the workpiece through the edge machining assembly.

It is also preferred if one, preferably each of the roller brushes comprises a first and a second roller segment, which are arranged axially next to one another in relation to the first axis of rotation and the two segments are mounted so as to be rotatable about the first axis of rotation, wherein the first and the second roller segment are driven by the first drive unit in a matching direction of rotation, preferably at different rotational speeds, or the first and the second roller segment are driven by the first drive unit in different directions of rotation. According to this embodiment, one, more or each of the roller brushes is subdivided into two or more roller segments, wherein these roller segments can be driven in the same direction of rotation but at different speeds, can be driven in different directions of rotation, or can be driven in the same direction and at the same speed, but can be furnished differently, for example may have different brush elements. In general, it is preferred for the roller segments to be able to be driven by means of the first drive unit, but in the case of this embodiment it may also be provided to provide two separate first drive units in order to drive the two roller segments independently of one another. The provision of such multiple roller segments enables in turn better adaptation of the machining action of the edge machining assembly to increase the edge machining efficiency and reduce the machining of the surfaces of the workpiece that adjoin the edge.

It is also preferred if the second axes of rotation are arranged one behind another along the guideway and each second axis of rotation guides a first axis of rotation of a roller brush, wherein two adjacent roller brushes are driven by the first drive unit preferably to rotate in mutually opposite directions of rotation about their respective first axis of rotation. According to this embodiment, it is provided that two roller brushes which are in succession along the guideway are driven in different directions of rotation in relation to the first axis of rotation. This modified drive direction in direct succession has the effect that even edges which are arranged at directly adjacent positions on a workpiece and have a different alignment, in particular an alignment that differs by 180°, that is to say for example edges at a narrow slot, can be effectively deburred and rounded by the edge machining assembly, since for the two edge alignments a direction of rotation of the roller brushes which is favorable for the edge machining sweeps over this edge combination in direct succession.

The edge machining assembly can also be developed further by a sensor device for detecting one or more workpieces, wherein the sensor device is arranged upstream of the edge machining assembly in relation to a conveying direction of the workpieces through the edge machining assembly and is connected in signaling terms to a controller which is in turn connected in signaling terms to the first, second and/or third drive unit(s) and is designed to actuate the first, second and/or third drive unit(s) on the basis of a signal from the sensor device. According to this embodiment, a sensor device which can detect properties of the workpiece before it is machined by the edge machining assembly is provided. The sensor device can in principle be designed in a different way. Thus, the sensor device may be designed solely to detect the dimension and placement of workpieces on the workpiece support surface, this for example being effected by optical scanning, an ultrasound sensor system or mechanical scanning. On the basis of such detection by a sensor, the drive units can be actuated such that in particular those regions of the workpiece support surface that are occupied by workpieces are swept over by the roller brushes to the desired extent and the workpieces are machined as a result. The sensor device may also detect further information about the workpiece, for example the workpiece thickness, the presence and alignment of edges at recesses of the workpiece, and on the basis of these sensor-detected properties the controller can develop a preferred actuation of the drive units, for example in order as a result to set a machining direction of the brush rollers which is particularly favorable for the edge machining in the alignment of the edge that was detected by the sensor.

In this respect, it is particularly preferred if the sensor device is a sensor strip which extends transversely to the conveying direction over a width of the edge machining assembly and is intended to optically scan the workpiece/the workpieces and is designed to detect a dimension and/or alignment of a recess in a workpiece, or to detect a region of the workpiece that is bent out of a workpiece plane lying in the conveying direction, or to detect a width dimension of the workpiece that extends in the width of the edge machining assembly, or to detect a workpiece thickness, and to actuate the first, second and/or third drive unit(s) on the basis of one or more of these detected properties. According to this embodiment, the sensor device is in the form of a sensor strip, which extends transversely to the conveying direction of the workpieces and therefore can detect all the workpieces deposited on the workpiece support surface, wherein in particular dimensions and/or an alignment of recesses in the workpiece can be detected in order on that basis to create a preferred parametrization of the actuation of the drive units and to optimize the machining direction and speed of the roller brushes to this dimension and also direction. It is also possible to detect bent regions of the workpiece, which thus project beyond a workpiece surface, in order to especially actuate roller brushes that sweep over such bent regions at the moment of contact with the bent region, for example to reduce their rotational speed about the first axis of rotation and to increase the rotational speed again to a desired level after they have swept over the bent region. It is also possible to detect a width and a thickness of the workpiece or the position of the edges in order as a result to set a corresponding adjustment and machining width implemented by the workpieces and consequently to reduce or avoid altogether the idling of the roller brushes over regions of the workpiece support surface that are not occupied by workpieces or over workpiece regions that do not have edges and to set the contact pressure of the roller brushes on the workpiece by corresponding axial adjustment in the direction of the second axes of rotation.

The edge machining assembly may also be developed further by an adjustment device for setting the spacing of the first axes of rotation from a workpiece support surface, wherein the adjustment device is connected in signaling terms to an adjustment controller which is designed to control the adjustment device to set a spacing or a contact pressure between the roller brush and a workpiece supported on the workpiece support surface. According to this embodiment, the spacing of the roller brushes from the workpiece support surface can be adjusted in controlled fashion by an adjustment device, as a result of which it is possible both to control an increase or reduction in the contact pressure of the roller brushes on the workpiece and to track the position of the first axes of rotation in order to compensate for wear of the roller brushes. The adjustment device may be designed to actuate each roller brush individually in terms of its spacing from the workpiece support surface or the contact pressure, or all of them together, or to for example set a determined spacing/a determined contact pressure for those respective roller brushes that pass through a predetermined region of the closed guideway and to set another spacing/another contact pressure in another region of the closed guideway.

In this respect, it is particularly preferred if the adjustment controller is designed to actuate the adjustment device on the basis of a drive parameter of the first, second or third drive unit(s), on the basis of a workpiece thickness and/or on the basis of a wear state of the roller brushes. According to this embodiment, a signal value characterizing the wear or the machining resistance is ascertained on the basis of a drive parameter, for example a drive power, or a drive motor current of a drive unit and the adjustment device is actuated on the basis of this signal value in order to use this as a basis to compensate for a wear state. As an alternative or in addition, the workpiece thickness can also be detected, and the adjustment device can be actuated on the basis of this workpiece thickness. Lastly, it is also preferred alternatively or additionally to detect a wear state of the roller brushes, for example by using a sensor to directly scan the roller brushes, and to use this signal value to actuate the adjustment device.

The edge machining assembly according to the invention can also be developed further by a sensor device for detecting an edge rounding on one or more workpieces, wherein the sensor device is arranged downstream of the edge machining assembly in relation to a conveying direction of the workpieces through the edge machining assembly and is connected in signaling terms to a controller which in turn is connected in signaling terms to a conveying device for conveying the workpieces and is designed to actuate the conveying device on the basis of the edge rounding detected by the sensor device, in particular in such a way as, if an edge rounding that results in an edge radius which is smaller than a predetermined minimum edge radius is found, to actuate the conveying device to perform conveying in reverse, in order to convey the workpiece back into the edge machining assembly and in order to control another machining operation by the edge machining assembly, and/or to actuate the first, second or third drive unit with a modified drive parameter, and/or to actuate an adjustment device for setting the spacing of the first axes of rotation from a workpiece support surface, in order to increase a contact pressure between the roller brushes and a workpiece supported on the workpiece support surface. According to this further development, as an alternative to the aforementioned sensor device or in addition to this sensor device, a sensor device which detects the workpiece after machining by the roller brushes and can detect the edge rounding may be provided. Such a sensor device can also detect the edge rounding as an actual geometric measured value by way of optical scanning. The sensor device can, however, also be designed such that it ascertains information about the degree of the edge rounding by way of comparative observation of the optical reflection behavior of the edges before the machining and after the machining, that is to say corresponding to an upstream and a downstream sensor unit. On the basis of this information about the edge rounding, a decision can then be made in a controller as to whether the degree of edge rounding corresponds to a desired value or exceeds it, or whether the desired value has not yet been reached. If the desired degree of edge rounding has not yet been reached, it is then possible to use this sensor signal as a basis to actuate a return of the workpiece under the roller brushes by correspondingly actuating the conveying device of the workpiece support surface in order to machine the edges again, or this can be signaled to the operator in order for them to feed the workpiece back to the edge machining assembly.

In addition to this possible correction, it can also be provided to adapt the drive parameters of one or more drive units in order to optimize the machining procedure carried out by the brush rollers. Similarly, it is alternatively or additionally possible to use an adjustment device to increase or reduce the contact pressure of the brush rollers on the workpiece, in order as a result to improve edge machining which the sensor device has established as being insufficient.

In this respect, it is preferred in particular if the aforementioned edge machining assembly is developed further by an optimizing unit, which is designed, for a first edge that is to be deburred on a workpiece that is characterized and stored in memory by a sensor device according to its position, length or spacing from another edge, on the basis of a comparison of a first edge radius, ascertained after carrying out a first deburring operation performed with a first control data set, with a second edge radius, ascertained after carrying out a second deburring operation performed with a second control data set, wherein a control data set describes an adjustment force between the roller brushes and the workpiece and/or a direction, a sequence of changes in direction and/or a speed of rotation of the roller brushes about the first axes of rotation, the rotation of the first axes of rotation about the second axes of rotation, and/or the movement of the second axes of rotation along the guideway, to store in memory, as optimized control data set, the first or the second control data set or a third control data set formed from the first and the second control data set by extrapolation or interpolation, if the comparison has produced a correspondingly better deburring operation as a result of the first or the second control data set or allows a better deburring operation to be expected as a result of the third control data set, and to carry out a deburring operation at a subsequent time on a second edge, which is characterized similarly or correspondingly to the first edge according to its position, length or its spacing from another edge, using the optimized control data set. According to this embodiment, the edge machining assembly is designed to use a previously machined edge as a basis to detect the machining result of this edge and to link the result to machining parameters, that is to say in particular a control data set for the first, second and third drive units, and to geometric parameters of the edge, that is to say in particular its alignment. This makes it possible, if favorable machining of the edge was found with these parameters, to store a favorable control data set in memory and subsequently to use it in the same or a slightly modified form for edges positioned in the same way. Upon subsequent machining of an edge with a comparable alignment, length, spacing from another edge or the like, it is possible to establish, when this edge is machined with different control data for the drive units, whether this will achieve more efficient or less efficient edge machining. The better of the two control data sets for this type of edge (position, alignment, length, spacing to another edge) can thus be ascertained and stored in memory. In an in turn subsequent machining operation, it is then possible to use the detected alignment of the position of an edge, its length and/or its spacing from another edge to select the control data set ascertained as optimum beforehand and as a result to machine this edge with an optimized control data set for the actuation of the drive units.

It should be understood that this optimization operation can be repeated as desired, or that further relevant parameters, such as the nature of the material of the workpiece, can be taken into account and in this way, with increasing use, the edge machining assembly can store in memory in its controller a multiplicity of optimized control data sets for corresponding edges with a certain alignment, length, spacing from other edges. It should also be understood that this optimization process is not restricted to using two different control data sets as a basis to select the control data set that has been found to be more efficient, but also can be developed further such that a further control data set is calculated from these two control data sets, for example by interpolation, that is to say ascertaining a third control data set which is in the range of values between these two control data sets, or by extrapolation, that is to say by logical, for example proportional extension of the values for the control data above the higher value of the two control data sets or below the lower value of the two control data sets, and to use this third control data set as optimum control data set.

A further aspect of the invention is a surface grinding machine, comprising a workpiece support surface, a conveying device for conveying workpieces on the workpiece support surface, and a plurality of grinding assemblies which are arranged one behind another in a row and are intended for the sequential machining by grinding of a workpiece conveyed by the conveying device, characterized in that one of the grinding assemblies is an edge machining assembly as claimed in one of the preceding claims. As explained in the introduction, the edge machining assembly according to the invention is suitable for insertion in such a surface grinding machine and for carrying out edge machining as a machining step of this surface grinding machine. This can be supplemented by subsequent or preceding machining steps on the workpiece by means of other grinding assemblies.

A further aspect of the invention is the use of an edge machining assembly having the structure explained above for deburring and/or for rounding edges which are formed on the periphery or at recesses of a workpiece, wherein in particular edges on plate-like workpieces can be machined particularly effectively by the use of the edge machining assembly.

Lastly, a further aspect of the invention is a method for deburring and/or rounding edges on a workpiece, comprising the following steps: rotating a multiplicity of roller brushes about a respective first axis of rotation which is preferably parallel to a surface of the workpiece, rotating each of the first axes of rotation about a respective second axis of rotation which is assigned to the respective first rotation and is not aligned parallel, preferably is aligned perpendicularly, to the first axis of rotation, moving the second axes of rotation along a closed guideway which is preferably in a plane aligned parallel to the first axes or rotation or perpendicularly to the second axes of rotation. This method according to the invention can preferably be carried out by an edge machining assembly or a surface grinding machine of the type described above. It should be understood that, in the case of this method, it is in particular also possible to use the further developments of the edge machining assembly according to the invention that were explained above and to carry out the method steps enabled as a result.

In particular, it is preferred to develop the method further in that a position, alignment and/or a radius of an edge on the workpiece is ascertained as measurement parameter by means of a sensor device before and/or after the deburring operation and in that the direction and/or speed of rotation of the roller brushes about the first axes of rotation, the rotation of the first axes of rotation about the second axes of rotation, and/or the movement of the second axes of rotation along the guideway is controlled on the basis of the measurement parameter.

Figure 2:
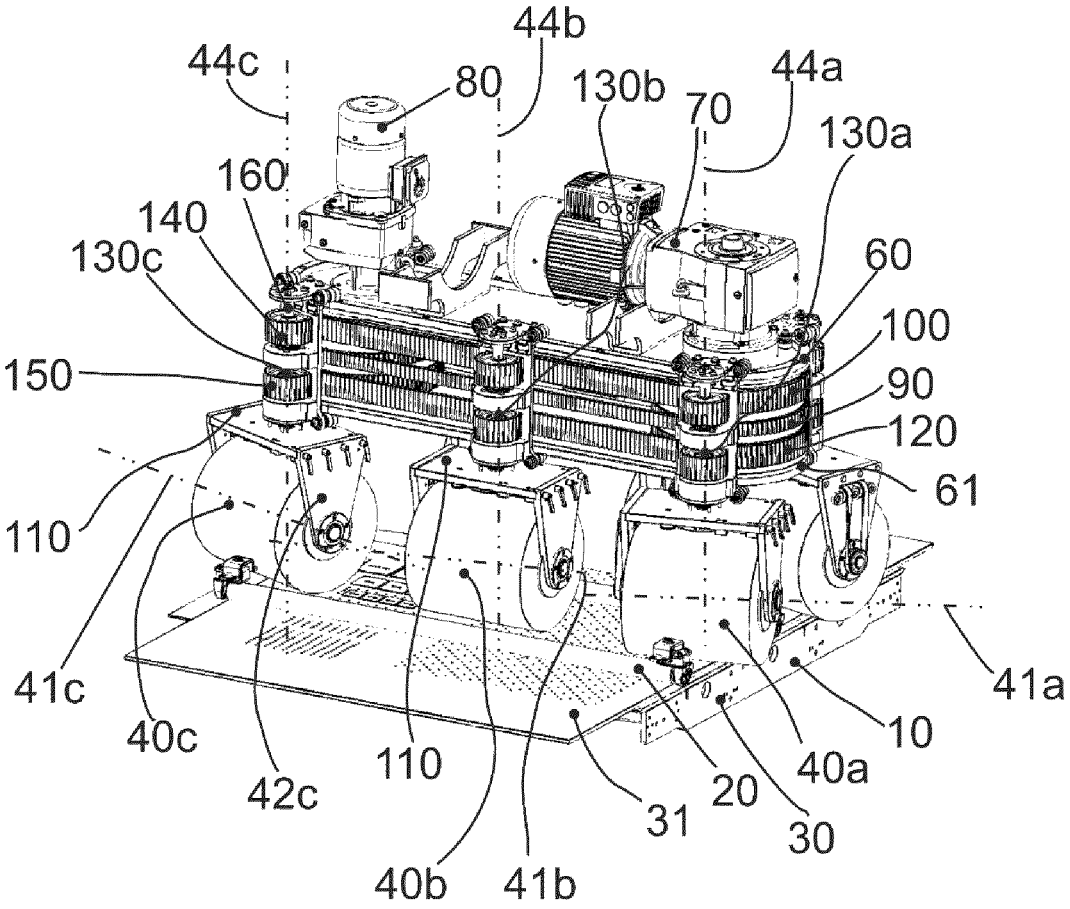
Figure 3:
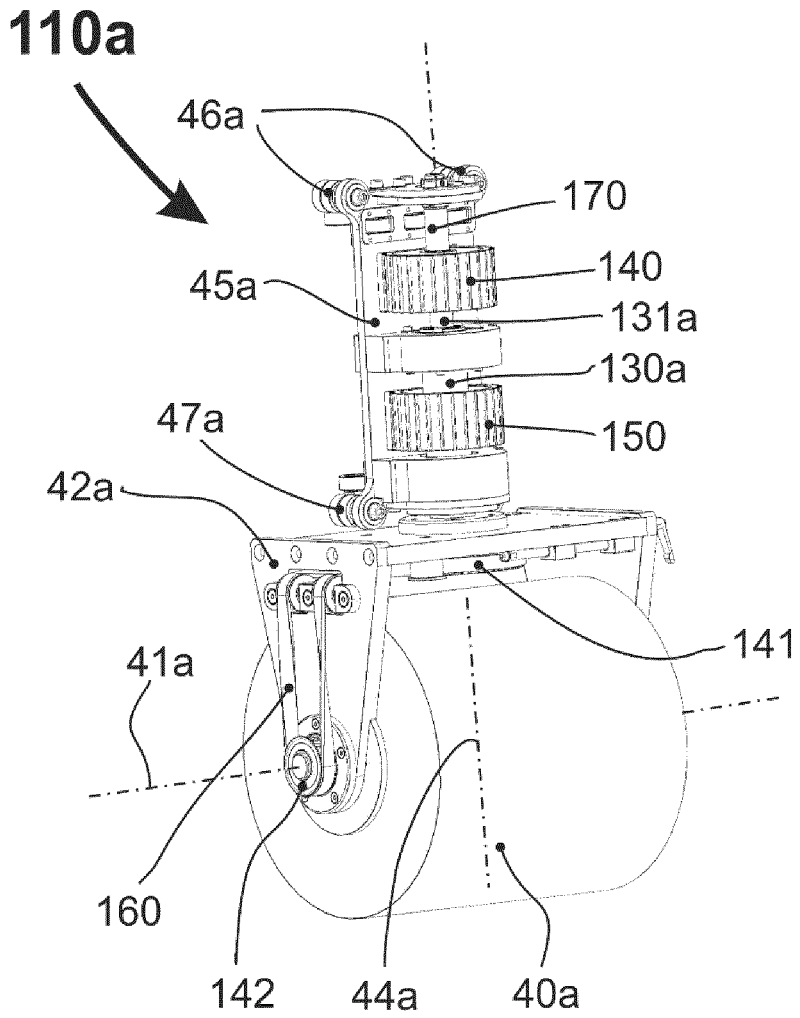
Figure 4:
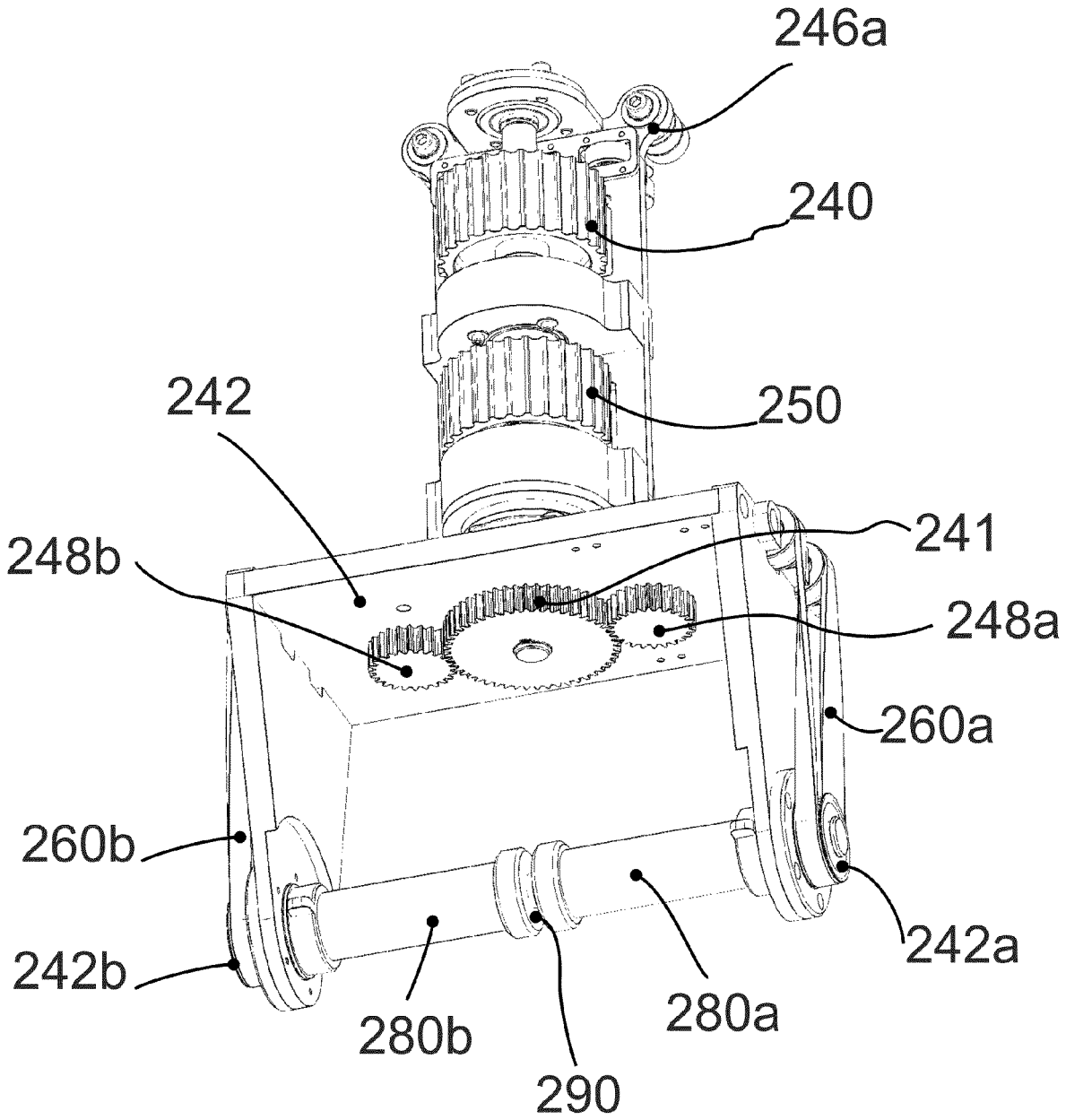
Figure 5:
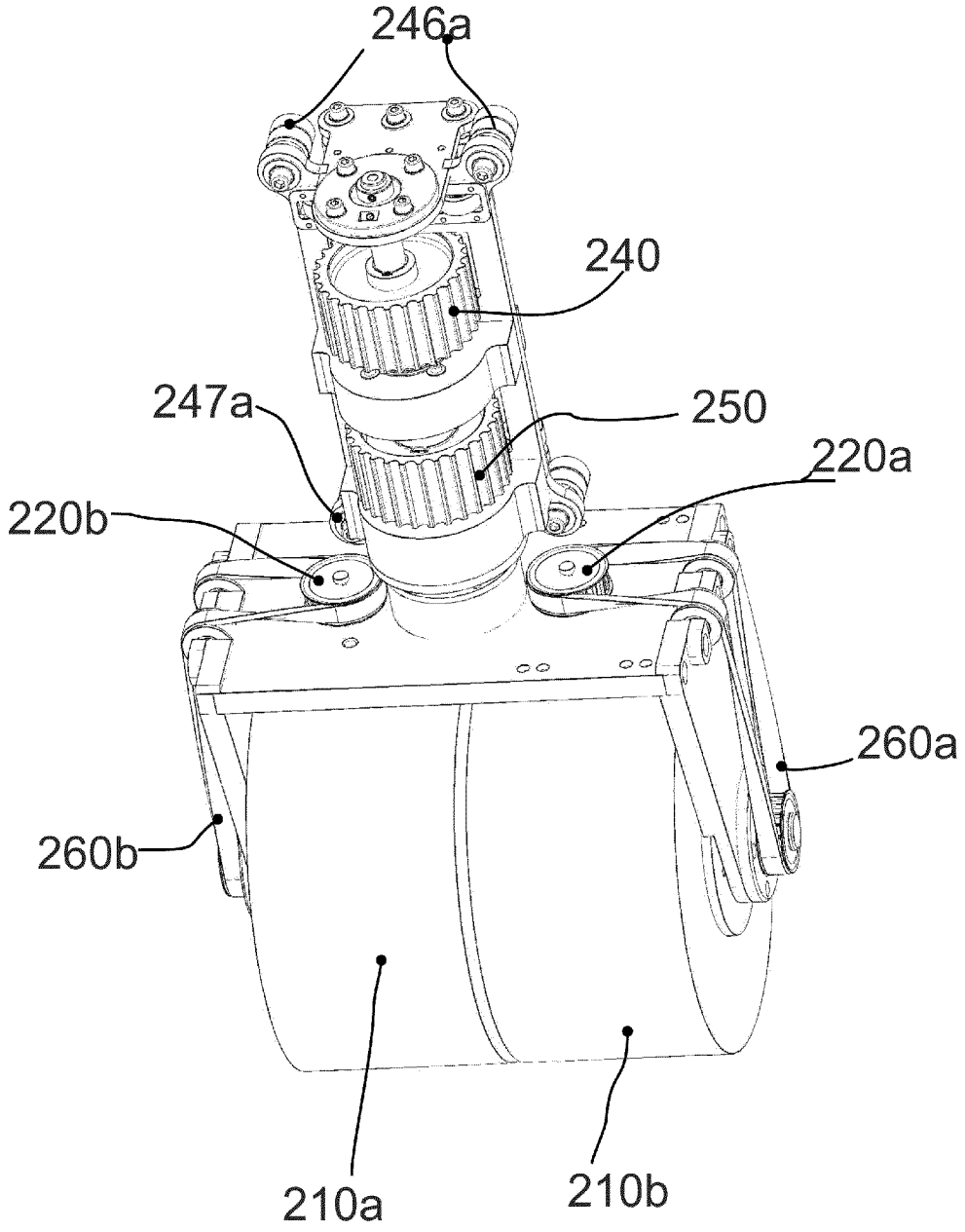
Figure 6:
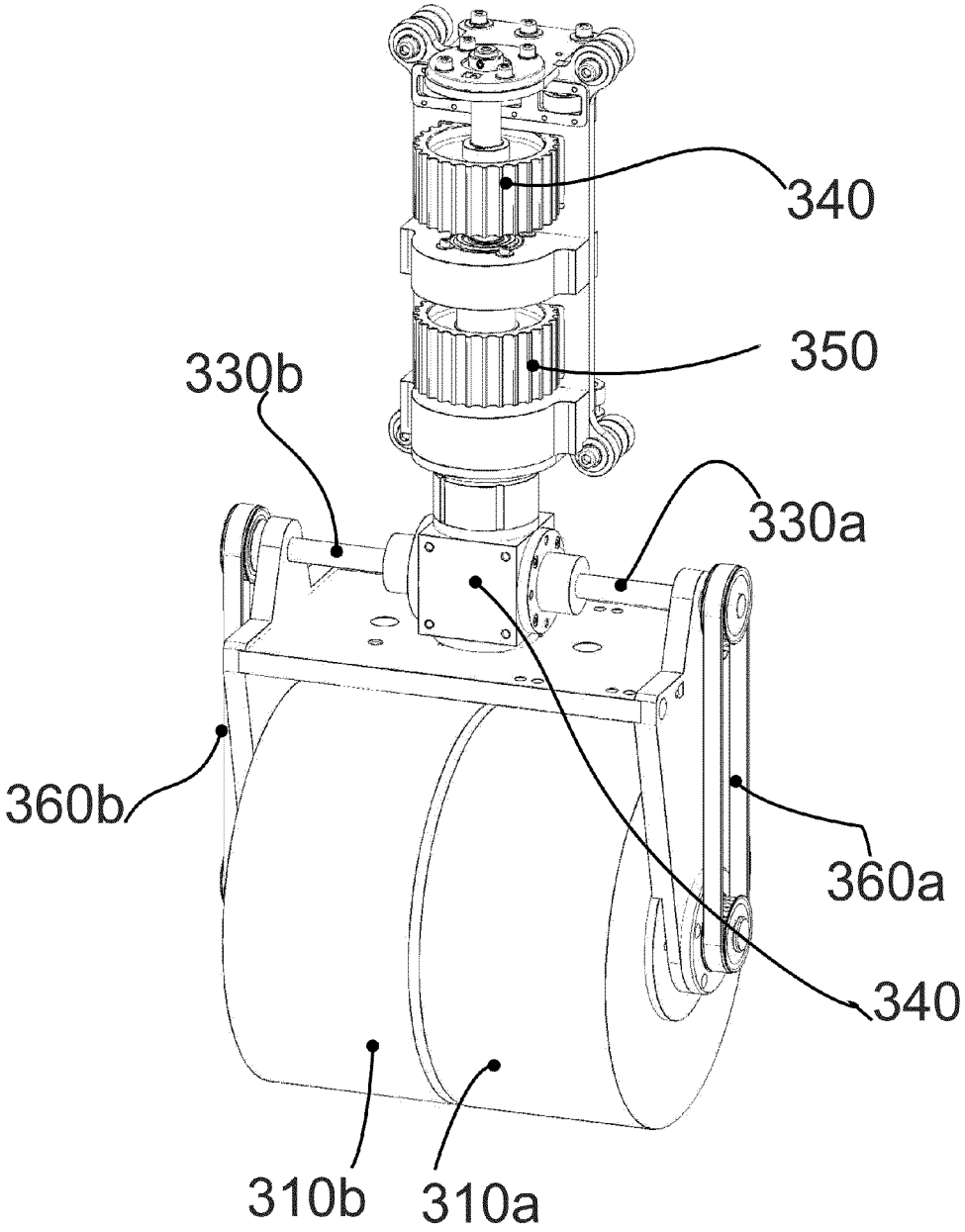
Figure 7:
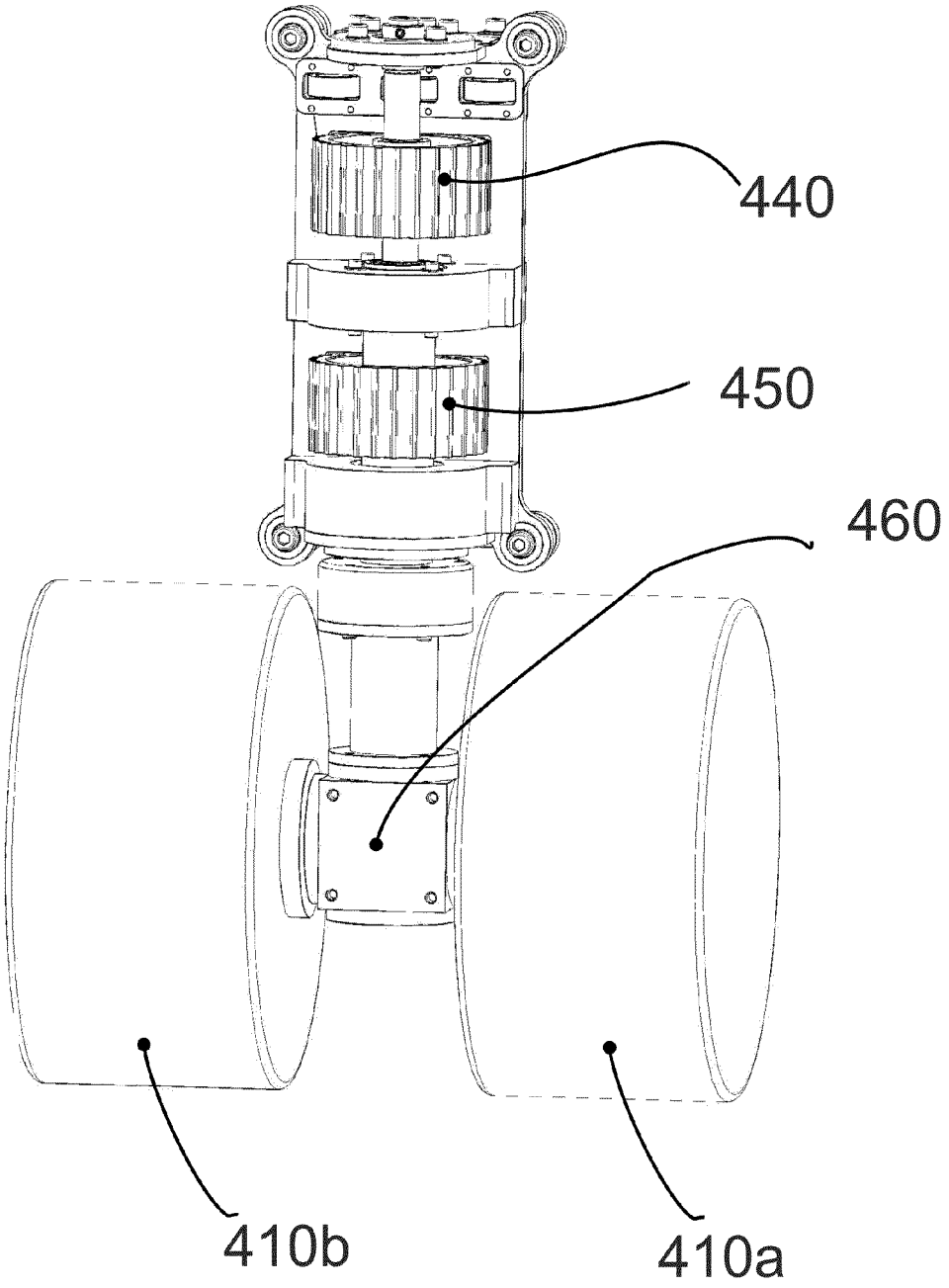

A preferred embodiment of the invention will be explained on the basis of the appended figures, in which:

FIG. 1 shows a frontal view of a detail of a grinding machine according to the invention comprising an edge machining assembly according to the invention installed therein, FIG. 2 shows a perspective view, obliquely laterally at the top front, of an edge machining assembly according to the invention, and FIG. 3 shows a perspective partial view of a first embodiment of a satellite of the edge machining assembly according to FIG. 2;

FIG. 4 shows a perspective partial view, obliquely from below, of a second embodiment of a satellite of the edge machining assembly according to FIG. 2 with the option of receiving two roller brushes; the two roller brushes are masked for better understanding, FIG. 5 shows a perspective partial view, obliquely from above, of the satellite according to FIG. 4, the two roller brushes being illustrated, FIG. 6 shows a perspective partial view, obliquely from above, of a third embodiment of a satellite of the edge machining assembly according to FIG. 2 with the option of receiving two roller brushes, and FIG. 7 shows a perspective partial view, obliquely from above, of a fourth embodiment of a satellite of the edge machining assembly according to FIG. 2 with the option of receiving two roller brushes.

Figure 8:
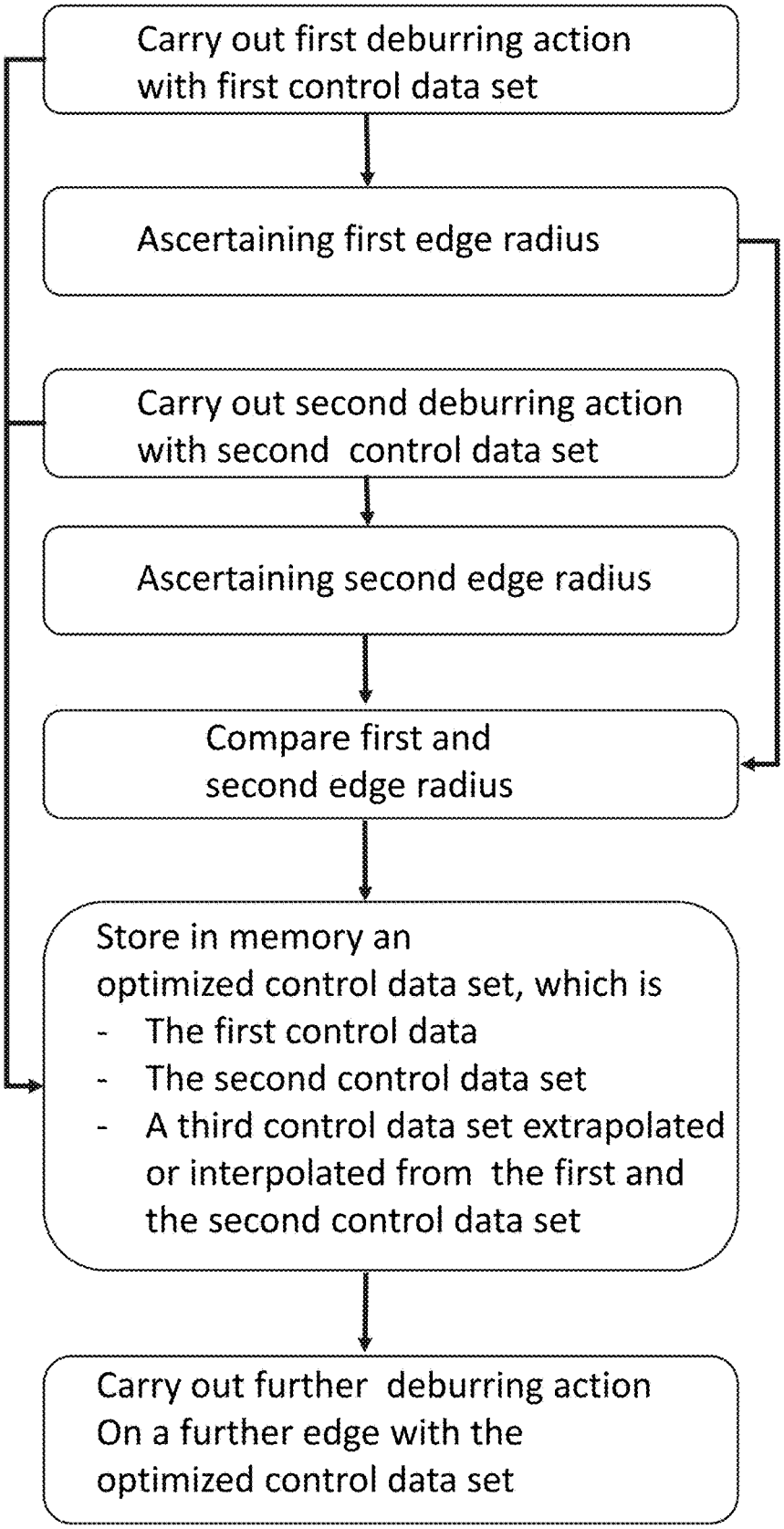

FIG. 8 shows a flowchart for an optimizing unit.

FIG. 1 shows a detail of a grinding machine comprising two machining assemblies inserted therein. Arranged on the right-hand side is a longitudinal grinding assembly L which has a contact roller KW and can perform surface machining on a workpiece 31 which passes through on a machine table 30 in a horizontal plane. For this purpose, the longitudinal grinding assembly has an endless belt grinding body, which is brought into linear contact with the workpiece by the contact roller KW.

An edge machining assembly 60 according to the invention is arranged on the left, next to the longitudinal grinding assembly. This edge machining assembly 60 can perform edge machining on the workpiece 31.

The workpiece 31, supported on the machine table 30, is conveyed through the grinding machine in a conveying direction F from right to left in FIG. 1 by a workpiece conveying device 30*a* configured as a belt. The machine table 30, the longitudinal grinding assembly L and the edge machining assembly 60 are fastened to a machine housing 10 and as a result are positioned in their positions relative to one another in a stiff structure. Also arranged on the machine housing 10, on a extension arm, is an operating unit 20, which comprises both a control unit in the form of a programmable computer unit and a corresponding user interface for inputting and outputting parameters and information.

FIG. 2 perspectively depicts an isolated view of the edge machining assembly. In this view, the longitudinal grinding assembly and parts of the machine table and of the machine housing are not depicted for the sake of better presentation of the edge machining assembly.

The edge machining assembly comprises a multiplicity of roller grinding bodies in the form of roller brushes 40*a, b, c*, . . . . Each of the roller brushes 40*a, b, c* is mounted so as to be rotatable about a respective first axis of rotation 41*a, b, c*, . . . . The first axes of rotation 41*a, b, c* are aligned parallel to the upwardly facing surface of the workpiece 30 to be machined, which is mounted on the machine table 30.

Each of the roller brushes 40*a, b, c* therefore forms a theoretically linear line of contact with the workpiece 31.

The roller brushes 40*a, b, c* are occupied by a multiplicity of brush elements which extend radially outward from a cylindrical central core. In the figures, the roller brushes 40*a, b, c* are depicted only symbolically.

Each roller brush 40*a, b, c* is mounted in a U-shaped holder 42*a, b, c* so as to be rotatable about the first axis of rotation. Each holding profile is connected on its upper side to a hollow shaft 130*a, b, c* extending in the vertical direction. These hollow shafts 130*a, b, c* are each mounted on a suspension frame 45*a, b, c* so as to be rotatable about a second axis of rotation 44*a, b, c*.

Each suspension frame 45*a* bears two guide rollers 46*a* at its upper end and likewise two such guide rollers 47*a* at its lower end. These guide rollers make it possible to move the suspension frame 45*a* in translation on a corresponding upper guide rail 60 and lower guide rail 61. These upper and lower guide rails 60, 61 each extend in a horizontally aligned plane and form a guideway in the shape of a closed lame oval in these planes.

A respective roller brush 40*a*, its U-shaped holder 42*a*, the hollow shaft 130*a* fastened thereto, and the suspension frame 45*a* with the guide rollers 46*a*, 47*a* fastened thereto form the main constituent parts of a structural unit in the form of a satellite 110*a*. The edge machining assembly comprises multiple such satellites and each of the satellites is guided on the upper and the lower guide rail 60, 61 for a translational movement along the closed guideway defined by these two guide rails 60, 61.

Three endless toothed belts, the ribbed sides of which face radially outward and which likewise extend in the same lame oval as the upper and the lower guide rail, are arranged between the upper and the lower guide rail.

A central toothed belt 90 is made to move in circulation relative to the upper and lower guide rails by a traction drive unit 70. Each of the suspension frames 45*a, b, c* is fastened to this central toothed belt 90, with the result that the satellites 110*a, b, c* are moved one after another along the lower and upper guide rails in a closed guideway as a result of the circulating movement of the central toothed belt 90.

A lower toothed belt 120, which is arranged underneath the central toothed belt and likewise extends in a closed oval guideway, interacts with a sprocket 150 which is arranged on each of the satellites and is connected fixedly in terms of torque to the hollow shaft 130*a* of the satellite. The toothed belt 120 may be stationary, that is to say not move in circulation, with the result that the circulating movement of the satellites causes the lower sprocket 150 to roll on the toothed belt and the U-shaped holder to rotate about the respective second axis of rotation 44*a, b, c* of the satellite via the hollow shaft. This second axis of rotation 44*a* extends concentrically to the hollow shaft 130*a* and extends in the vertical direction. The second axis of rotation 44*a, b, c* extends through the respective roller brush 40*a, b, c*. It preferably intersects this roller brush centrally between the two end faces of the roller brush and also preferably intersects the first axis of rotation 41*a, b, c*.

If the roller brush thus rotates about the first axis of rotation, a rotation of the roller brush about the second axis of rotation in the center of the roller brush does not cause the relative speed between the outer circumference of the roller brush and the workpiece to change, the relative speed is increased on a side of the roller brush that is radially on the outside in relation to the second axis of rotation by a superposition of the rotational speeds of the roller brush about the first and the second axis of rotation, and the relative speed of the outer circumference of the roller brush that is in contact with the workpiece is reduced on an opposite side of the roller brush that is radially on the outside in relation to the second axis of rotation by the same superposition. These kinematics result in a variable relative speed along the line of contact between the roller brush and the workpiece, the variable relative speed being favorable for edge machining and achieving effective machining of edges of any alignment and with any spacing from other edges.

An upper toothed belt 100, which interacts with an upper sprocket 140, extends underneath the central toothed belt. The upper sprocket 140 is fastened fixedly in terms of torque on a drive shaft 131*a*, which extends through the hollow shaft 130*a* and the upper region of the U-shaped holder.

FIG. 3 shows a first embodiment of a satellite which comprises a roller brush, its holder and bearing arrangement, and part of its drive unit. A pulley 141, which may be in the form for example of a V-belt pulley, poly V-belt pulley or toothed belt pulley, is arranged at the lower end of this drive shaft. A drive belt 160 is wound around this pulley 141. The rest of the course of the drive belt is guided laterally out of the U-shaped holder, deflected by 90° and looped around a pulley 142 which is connected fixedly in terms of torque to the brush roller and rotates about the first axis of rotation together with the brush roller. In this way, a rotation, brought about by the toothed belt 100, of the upper sprocket 140 can be transmitted to the brush roller 40*a* and the brush roller as a result can be driven in a rotational movement about the first axis of rotation 41*a*.

In principle, it should be understood that the toothed belts 100 and 120 may be in the form of stationary toothed belt segments and produce the rotation of the roller brushes about the second axis of rotation and about the first axis of rotation as a result of the rolling movement of the upper sprocket 140 and the lower sprocket 150 on the upper toothed belt 100 and the lower toothed belt 120. In this case, both the movement of the satellites 110 along the guideway and the two rotational movements about the first and the second axis of rotation can be performed by a single motor drive, by means of which the central toothed belt 90 is moved in circulation along the oval guideway.

Both the upper and the lower toothed belt 100, 120 or the two of them may, however, also be in the form of drivable toothed belts, which can similarly move in circulation and as a result generate an individual rotational movement about the first axis of rotation and an individual rotational movement about the second axis of rotation. In this case, one, or two, additional motor drive(s) for driving the upper and the lower toothed belt is/are correspondingly necessary and an independent movement shape in terms of the circulating movement of the satellites along the closed guideway, the rotation about the second axis of rotation and the rotation about the first axis of rotation can be generated by providing three such drive motors. This makes it possible to individually adapt the kinematics for certain edge machining operations. In the exemplary embodiment illustrated, a first drive motor 70 which makes the upper toothed belt 100 move in circulation is arranged above the upper guide rail. Furthermore, a third drive motor 80 which makes the central toothed belt 90 move in circulation is arranged above the upper guide rail. The lower toothed belt is stationary, and therefore the rotational speed about the second axis of rotation and the movement speed along the guideway are proportional to one another. As an equipment variant, the lower toothed belt could, however, likewise be made to move in circulation by a transmission on the first drive motor or by a second drive motor.

On the machine housing 10, it is also the case that a first sensor strip 200 is arranged in the run-in region and a second sensor strip 210 is arranged in the run-out region. The two sensor strips 200, 210 extend over the entire width of the run-in region and completely scan a workpiece 31 or multiple workpieces, which runs/run through underneath the sensor strips, by means of an optical scanner.

In this respect, the sensor strip 200 in the run-in region serves to detect the side and alignment of recesses and the edges formed there and also the outline with the corresponding edges of workpieces which are conveyed on the machine table to the edge machining assembly and to forward these data to the controller in the operating unit 20. The drive motors of the edge machining assembly can then be correspondingly actuated on the basis of these data.

The sensor strip 210 in the run-out serves to optically detect a workpiece machined by the edge machining assembly and in the process ascertain the edge rounding. This is also achieved by optical scanning. If this measurement by means of the sensor strip 210 determines that the edge rounding is sufficient, the workpiece can continue to run through the grinding machine and optionally be fed for further machining steps. By contrast, if the edge radius is below a desired minimum value, the workpiece is conveyed back to the edge machining assembly and undergoes edge machining again in order to produce the desired edge radius. In the process, the drive motors of the edge machining assembly can be actuated such that optionally such post-machining takes place only in certain regions in which the edge radius was found to lie below what is desired.

As shown by FIG. 8, it is preferred in particular if the aforementioned edge machining assembly is developed further by an optimizing unit, which is designed, for a first edge that is to be deburred on a workpiece that is characterized and stored in memory by a sensor device according to its position, length or spacing from another edge, on the basis of a comparison of a first edge radius, ascertained after carrying out a first deburring operation performed with a first control data set, with a second edge radius, ascertained after carrying out a second deburring operation performed with a second control data set, wherein a control data set describes an adjustment force between the roller brushes and the workpiece and/or a direction, a sequence of changes in direction and/or a speed of rotation of the roller brushes about the first axes of rotation, the rotation of the first axes of rotation about the second axes of rotation, and/or the movement of the second axes of rotation along the guideway, to store in memory, as optimized control data set, the first or the second control data set or a third control data set formed from the first and the second control data set by extrapolation or interpolation, if the comparison has produced a correspondingly better deburring operation as a result of the first or the second control data set or allows a better deburring operation to be expected as a result of the third control data set, and to carry out a deburring operation at a subsequent time on a second edge, which is characterized similarly or correspondingly to the first edge according to its position, length or its spacing from another edge, using the optimized control data set. According to this embodiment, the edge machining assembly is designed to use a previously machined edge as a basis to detect the machining result of this edge and to link the result to machining parameters, that is to say in particular a control data set for the first, second and third drive units, and to geometric parameters of the edge, that is to say in particular its alignment. This makes it possible, if favorable machining of the edge was found with these parameters, to store a favorable control data set in memory and subsequently to use it in the same or a slightly modified form for edges positioned in the same way. Upon subsequent machining of an edge with a comparable alignment, length, spacing from another edge or the like, it is possible to establish, when this edge is machined with different control data for the drive units, whether this will achieve more efficient or less efficient edge machining. The better of the two control data sets for this type of edge (position, alignment, length, spacing to another edge) can thus be ascertained and stored in memory. In an in turn subsequent machining operation, it is then possible to use the detected alignment of the position of an edge, its length and/or its spacing from another edge to select the control data set ascertained as optimum beforehand and as a result to machine this edge with an optimized control data set for the actuation of the drive units.

The entire edge machining assembly is supported or suspended in the vertical direction within the machine frame 10 by means of hydraulic cylinders, wherein other configurations with a spring-mounted suspension/support or a pneumatically assisted suspension or support are also possible. The suspension force or supporting force of this suspension or support, respectively, can be set in order to be able to set a contact pressure of the roller brushes on the workpiece as a result.

FIG. 4 shows a second embodiment of a satellite. In this embodiment, the satellite is designed to receive two roller brushes 210*a, b*. Here, the two roller brushes 210*a, b* lie concentrically on the first axis of rotation and both rotate about this first axis of rotation.

For this purpose, at the lower end the internal drive shaft 131*a* bears a toothed wheel 241, which meshes on either side with two sprockets 248*a, b*. The two sprockets 248*a, b* are mounted rotatably in the upper plate of the U-shaped holder 242 and on the top side of this upper plate bear a respective pulley 220*a, b*. These pulleys 220*a, b* are to the side of the hollow shaft 130*a* and the drive shaft 131*a* of the satellite that extends in the hollow shaft 130*a*.

A drive belt 260*a*, which is deflected downward by 90° at the right-hand periphery of the upper plate of the U-shaped holder and extends to a pulley 242*a*, which is fixed in terms of torque with a receiving portion 280*a* for one of the two roller brushes 210*a*, is looped around the right-hand pulley 220*a*. Correspondingly, a drive belt 260*b* extends from the pulley 220*b* to a pulley 242*b*, which is connected to a second receiving portion 280*b* for the second roller brush 210*b*. The pulleys 242*a, b* and the receiving portions 280*a, b* are coaxial with the first axis of rotation. The two receiving portions 280*a, b* are connected to one another by means of a freewheeling support shaft 290, as a result of which the two receiving portions 280*a, b* are centrally supported and axially centered on one another.

The two receiving portions 280*a, b* are designed to receive the two roller brushes 210*a, b* fixedly in terms of torque.

In the exemplary embodiment illustrated according to FIGS. 4 and 5, the drive force for the rotation of the two roller brushes about the first axis of rotation is distributed to two sides of the U-shaped holder 242 and distributed to the roller brushes 210*a, b* by the drive belts 260*a, b*. In the exemplary embodiment, this division is performed by means of the force distribution from the toothed wheel 241 to the sprockets 248*a, b* and via the pulleys 220*a, b* and the drive belts 260*a, b* to the pulleys 242*a, b*. In principle, this distribution of the drive force to the two roller brushes can also be performed in another way. According to the invention, the first drive unit generally comprises a mechanical division of the drive force for the rotation of two roller brushes about a shared first axis of rotation, by means of which the two roller brushes are driven separately.

FIGS. 4 and 5 depict a configuration in which the two roller brushes 210*a, b* rotate about the first axis of rotation in opposite directions of rotation and at the same rotational speed. In other embodiment variants, it can be provided to drive the two roller brushes 210*a, b* at different rotational speeds, for example by selecting a different number of teeth for the sprockets 248*a, b* or by selecting a different effective diameter for the pulleys 220*a, b* or effective diameter for the pulleys 242*a, b* or a combination of several of these measures. Furthermore, in other embodiments, the two roller brushes can also be driven about the first axis of rotation in the same directions of rotation. This can be achieved, for example, by crossing over one of the belts 260*a* or 260*b*.

In principle, it should be understood that, instead of the division of the drive force via the toothed wheel 241 and the sprocket 248*a, b*, it would also be possible to perform a force distribution in the case of which, for example, instead of the toothed wheel 241, two coaxial and mutually adjacent pulleys are arranged and the drive belts 260*a, b* after deflection are guided through corresponding openings in the side walls of the U-shaped holder and loop around these pulleys, as illustrated for example in the embodiment shown in FIG. 3.

FIG. 6 shows a third embodiment of a satellite. This third embodiment is likewise equipped with two mutually coaxial roller brushes 310*a, b* in a U-shaped holder.

The embodiment according to FIG. 6 differs from the embodiment according to FIGS. 4 and 5 in the manner in which the two roller brushes are driven in rotation about the first axis of rotation. In the embodiment according to FIG. 6, a transfer gearbox 340 is arranged between the hollow shaft and the U-shaped holder. This transfer gearbox may for example be in the form of a bevel gear mechanism having a sprocket placed on the drive shaft 131*a* and two ring gears.

The rotational force about the second axis of rotation is transmitted from the hollow shaft to the U-shaped holder via the housing of this transfer gearbox 340.

The drive shaft, extending through the hollow shaft, for the rotation of the roller brushes about the first axis of rotation enters the transfer gearbox 340 as input drive shaft and there is deflected by 90° and divided up into two drive shafts 330*a, b*, which are connected for example within the bevel gear mechanism to a respective one of the two ring gears.

The two drive shafts 330*a, b* extend parallel to the first axis of rotation on both sides of the U-shaped holder. Arranged at the end of the two drive shafts 330*a, b* in turn are pulleys which transfer the rotational movement to corresponding pulleys 343*a, b* by means of respective drive belts 360*a, b*. These two pulleys 343*a, b* drive the two roller brushes 310*a, b* in the same way as in the embodiment according to FIGS. 4 and 5. It is also possible in this embodiment to select the same or different rotational speeds for the two roller brushes 310*a, b* and the same or opposite directions of rotation for the two roller brushes 310*a, b* by correspondingly designing and dimensioning the transfer gearbox 340 and the pulleys and optionally by crossing over one of the two belts 360*a, b*.

FIG. 7 shows a fourth embodiment of a satellite for the edge machining assembly according to the invention. In this embodiment, the hollow shaft 130*a* on the toothed wheel 450 together with the drive shaft 131*a*, extending therein, on the toothed wheel 440 extends as far as the region between the two roller brushes 410*a, b* and is connected to a transfer gearbox 460 there.

The drive force about the second axis of rotation is in turn transmitted directly via the hollow shaft to the housing of this transfer gearbox 460 and the housing transmits this rotational movement to the first axis of rotation. The drive force of the drive shaft 131*a* extending in the hollow shaft 130*a* is distributed from the transfer gearbox 460 directly to the two roller brushes 410*a, b*, which are on the left-hand and the right-hand side of this transfer gearbox.

The transfer gearbox 460 therefore in principle has the same structure as the transfer gearbox 340, but in the fourth embodiment no U-shaped holder is provided and, owing to the position of the transfer gearbox 460 at the level of the first axis of rotation, it is not necessary to convey the drive force from the first drive unit by means of pulleys and drive belts in this embodiment variant. It is also the case in this embodiment that the same or opposite directions of rotation are selected for the two roller brushes 410*a, b* and/or the same or different rotational speeds are selected for the two roller brushes 410*a, b* by correspondingly dimensioning and selecting the transfer gearbox 460.

The invention claimed is:

1. An edge machining assembly for a wide grinding machine, comprising:

a plurality of cylindrical roller brushes, each cylindrical roller brush of the plurality of cylindrical brushes having a respective cylindrical surface and a multiplicity of brush elements on the respective cylindrical surface, wherein each cylindrical roller brush has a respective first axis of rotation which corresponds to a center longitudinal axis of the cylindrical roller brush, a first drive unit configured for driving each cylindrical roller brush in a rotational movement about the respective its first axis of rotation of each respective cylindrical roller brush, a plurality of holders, wherein each cylindrical roller brush is mounted in a respective holder of said plurality of holders, wherein each respective holder has a respective second axis of rotation, wherein each respective second axis of rotation is not aligned parallel to the respective first axis of rotation, wherein each cylindrical roller brush having a respective first axis of rotation is mounted so as to be rotatable about the respective second axis of rotation of the respective holder in which the respective cylindrical roller brush is mounted, a second drive unit configured for rotating each cylindrical roller brush having a respective first axis of rotation about the respective second axis of rotation of the respective holder in which the respective cylindrical roller brush is mounted, a plurality of suspension frames defining a third movement axis, wherein each respective holder having a respective second axis of rotation is mounted to one respective suspension frame of the plurality of suspension frames, wherein each respective suspension frame is guided for a movement guided by the third movement axis, a third drive unit configured for moving the plurality of holders having respective second axes of rotation in a movement guided by the third movement axis, wherein the third movement axis is in the form of a closed guideway, and each holder of the plurality of holders having a respective second axis of rotation is moved along the closed guideway by the third drive unit.

2. The edge machining assembly as claimed in claim 1, wherein one or more of the following are true:

the second axis of rotation of each respective holder is perpendicular to the first axis of rotation of the respective cylindrical roller brush mounted in the respective holder, the closed guideway is in a plane which is perpendicular to each second axis of rotation of each respective holder of the plurality of holders, and the closed guideway is in a plane which is parallel to each first axis of rotation of each respective cylindrical roller brush.

3. The edge machining assembly as claimed in claim 1, wherein the second axis of rotation of at least one holder of the plurality of holders extends through the respective cylindrical roller brush mounted in the at least one holder.

4. The edge machining assembly as claimed in claim 3, wherein each second axis of rotation of each respective holder of the plurality of holders extends through the respective cylindrical roller brush mounted in the respective holder.

5. The edge machining assembly as claimed in claim 1, further comprising a workpiece support surface; and a workpiece conveying device for conveying the workpiece support surface in a workpiece conveying direction.

6. The edge machining assembly as claimed in claim 5, wherein the workpiece support surface has a support width perpendicular to the workpiece conveying direction and the closed guideway extends in the direction of the support width over an extent which is greater than or equal to the support width.

7. The edge machining assembly as claimed in claim 5, wherein one or more of the following are true:

the workpiece support surface is parallel to each first axis of rotation, and the workpiece support surface is parallel to a plane in which the closed guideway extends.

8. The edge machining assembly as claimed in claim 1, wherein the second drive unit comprises a hollow shaft and the first drive unit comprises a drive shaft extending through the hollow shaft.

9. The edge machining assembly as claimed in claim 1, further comprising a drive motor, wherein one of the following is true:

the first drive unit and the second drive unit are coupled to the drive motor, the second drive unit and the third drive unit are coupled to the drive motor, and the first drive unit and the third drive unit are coupled to the drive motor.

10. The edge machining assembly as claimed in claim 1, further comprising a control unit, wherein the first drive unit comprises a first drive motor, the second drive unit comprises a second drive motor, and the third drive unit comprises a third drive motor, the control unit is connected for signal transmission to the first, second, and third drive motors, and the control unit is configured to actuate the first, second, and third drive units independently of one another.

11. The edge machining assembly as claimed in claim 1, wherein at least one of the cylindrical roller brushes comprises a first and a second roller segment which are arranged axially next to one another in relation to the respective first axis of rotation, and the first and second roller segments of the at least one of the cylindrical roller brushes are mounted so as to be rotatable about the respective first axis of rotation, and wherein the first and the second roller segments are driven by the first drive unit in a matching direction of rotation, or the first and the second roller segments are driven by the first drive unit in different directions of rotation.

12. The edge machining assembly as claimed in claim 11, wherein each of the cylindrical roller brushes comprises a first and a second roller segment which are arranged axially next to one another in relation to the respective first axis of rotation and the first and second roller segments are mounted so as to be rotatable about the respective first axis of rotation, wherein the first and the second roller segment are driven by the first drive unit in a matching direction of rotation, or the first and the second roller segment are driven by the first drive unit in different directions of rotation.

13. The edge machining assembly as claimed in claim 11, wherein the first and the second roller segments are driven by the first drive unit in the matching direction of rotation at different rotational speeds.

14. The edge machining assembly as claimed in claim 1, wherein the plurality of holders each with a respective second axis of rotation are arranged one behind another along the closed guideway, and wherein each holder with a second axis of rotation guides a respective first axis of rotation of the respective cylindrical roller brush mounted in the respective holder, wherein two adjacent cylindrical roller brushes of the plurality of cylindrical roller brushes are driven by the first drive unit to rotate in mutually opposite directions of rotation, each about the respective first axis of rotation of the respective cylindrical roller brush.

15. The edge machining assembly as claimed in claim 1, further comprising a sensor device for detecting one or more workpieces, wherein the sensor device is arranged at an upstream portion of the edge machining assembly in relation to a conveying direction of the one or more workpieces through the edge machining assembly, and a controller connected for signal transmission to the sensor device and terms to a controller which is in turn connected in signaling terms-to one or more of the first, second, and third drive units, wherein the controller is configured to actuate one or more of the first, second, and third drive units based on a signal from the sensor device.

16. The edge machining assembly as claimed in claim 15, wherein the sensor device is a sensor strip which extends transversely to the conveying direction over a width of the edge machining assembly to optically scan the one or more workpieces and is configured to detect one or more properties selected from one or more of a dimension and an alignment of a recess in a workpiece of the one or more workpieces, a region of the workpiece that is bent out of a workpiece plane lying in the conveying direction, a width dimension of the workpiece that extends in the width of the edge machining assembly, and a workpiece thickness, and wherein the controller is configured to receive via the signal transmission the one or more properties that are detected and to actuate one or more of the first, second, and third drive units based on the one or more properties.

17. The edge machining assembly as claimed in claim 1, further comprising an adjustment device for setting the spacing of the plurality of cylindrical roller brushes each having a respective first axis of rotation from a workpiece support surface, and an adjustment controller, wherein the adjustment device is connected for signal transmission to the adjustment controller which is configured to control the adjustment device to set a spacing or a contact pressure between each cylindrical roller brush and a workpiece supported on the workpiece support surface.

18. The edge machining assembly as claimed in claim 17, wherein the adjustment controller is configured to actuate the adjustment device based on one or more of a drive parameter of the first, second or third drive unit, a workpiece thickness, and a wear state of the roller brushes.

19. The edge machining assembly as claimed in claim 1, further comprising an edge rounding sensor device for detecting an edge rounding on one or more workpieces, wherein the edge rounding sensor device is arranged at a downstream portion of the edge machining assembly in relation to a conveying direction of the one or more workpieces through the edge machining assembly, a controller connected for signal transmission to the edge rounding sensor device, and a conveying device for conveying the one or more workpieces, wherein the conveying device is connected for signal transmission to the controller, and wherein the controller is configured to actuate the conveying device based on the edge rounding detected by the edge rounding sensor device.

20. The edge machining assembly as claimed in claim 19, further configured for a first edge that is to be deburred on a workpiece that is characterized and stored in memory by the sensor device according to its-position, length, or spacing of the first edge from another edge, based on a comparison of a first edge radius, ascertained after carrying out a first deburring operation performed with a first control data set, with a second edge radius, ascertained after carrying out a second deburring operation performed with a second control data set, wherein each of the first control data set and the second control data set describes one or more of (i) an adjustment force between the cylindrical roller brushes and the workpiece, (ii) one or more of a direction, a sequence of changes in direction, and a speed of rotation of the each cylindrical roller brush about the respective first axis of rotation, (iii) the rotation of each cylindrical roller brush with a first axis of rotation about a respective second axis of rotation, and (iv) the movement of each holder with a respective second axis of rotation along the guideway, to store in memory, as an optimized control data set, the first or the second control data set or a third control data set formed from the first and the second control data set by extrapolation or interpolation, if the comparison has produced a correspondingly better deburring operation as a result of the first or the second control data set or allows a better deburring operation to be expected as a result of the third control data set, and to carry out a deburring operation at a subsequent time on a second edge, which is characterized similarly or correspondingly to the first edge according to position, length, or spacing of the second edge from another edge, using the optimized control data set.

21. The edge machining assembly as claimed in claim 19, wherein the controller is configured such that if an edge rounding is found that results in an edge radius which is smaller than a predetermined minimum edge radius, the controller actuates one or more of:

the conveying device to perform conveying in reverse to convey the workpiece back into the edge machining assembly and to control another machining operation by the edge machining assembly, the first, second or third drive unit with a modified drive parameter, and an adjustment device for setting the spacing of each first axis of rotation from a workpiece support surface to increase a contact pressure between the cylindrical roller brushes and the workpiece supported on the workpiece support surface.

22. A wide surface grinding machine, comprising a workpiece support surface, a conveying device for conveying workpieces on the workpiece support surface, and a plurality of grinding assemblies which are arranged one behind another in a row and are intended for the sequential machining by grinding of a workpiece conveyed by the conveying device, wherein one of the grinding assemblies is an edge machining assembly as claimed in claim 1.

23. The use of an edge machining assembly as claimed in claim 1 for one or more of deburring and rounding edges on a periphery or at recesses of a workpiece.

24. The use of an edge machining assembly as claimed in claim 23, wherein the workpiece is a plate-like workpiece.

25. The edge machining assembly as claimed in claim 1, wherein the second axis of rotation of at least one holder of the plurality of holders intersects the first axis of rotation of the respective cylindrical roller brush mounted in the at least one holder.

26. The edge machining assembly as claimed in claim 25, wherein each second axis of rotation of each respective holder of the plurality of holders intersects the respective first axis of rotation of the respective cylindrical roller brush mounted in the respective holder.

27. A method for deburring and/or rounding edges on a workpiece, comprising steps of:

rotating a plurality of cylindrical roller brushes, each about a respective first axis of rotation, wherein each cylindrical roller brush is mounted in a respective holder of a plurality of holders, wherein each respective holder has a respective second axis of rotation, rotating each cylindrical roller brush of the plurality of cylindrical roller brushes about the respective second axis of rotation which is assigned to the respective first axis of rotation and is not aligned parallel to the respective first axis of rotation, and moving each respective holder having a respective second axis of rotation along a closed guideway.

28. The method as claimed in claim 27, wherein a position, alignment and/or a radius of an edge on the workpiece is ascertained as a measurement parameter by a sensor device before and/or after the deburring operation and wherein (i) the direction and/or speed of rotation of the plurality of cylindrical roller brushes each about the respective first axis of rotation, (ii) the rotation of the cylindrical roller brushes each about the respective second axis of rotation of the respective holder in which the respective cylindrical roller brush is mounted, and (iii) the movement of the plurality of holders along the closed guideway are controlled based on the measurement parameter.

29. The method as claimed in claim 27, wherein the respective first axis of rotation is parallel to a surface of the workpiece, the respective second axis of rotation is aligned perpendicularly to the first axis of rotation, and the closed guideway is in a plane aligned parallel to the first axes of rotation or perpendicularly to the second axes of rotation.

* * * * *